US011735129B2

(12) United States Patent
He

(10) Patent No.: US 11,735,129 B2
(45) Date of Patent: Aug. 22, 2023

(54) DISPLAY PANEL AND DRIVING METHOD THEREOF

(71) Applicant: TCL China Star Optoelectronics Technology Co., Ltd., Guangdong (CN)

(72) Inventor: Jhenwei He, Guangdong (CN)

(73) Assignee: TCL China Star Optoelectronics Technology Co., Ltd., Shenzhen (CN)

( * ) Notice: Subject to any disclaimer, the term of this patent is extended or adjusted under 35 U.S.C. 154(b) by 295 days.

(21) Appl. No.: 17/251,944

(22) PCT Filed: Nov. 19, 2020

(86) PCT No.: PCT/CN2020/129952
§ 371 (c)(1),
(2) Date: Dec. 14, 2020

(87) PCT Pub. No.: WO2022/057076
PCT Pub. Date: Mar. 24, 2022

(65) Prior Publication Data

US 2022/0319455 A1 Oct. 6, 2022

(30) Foreign Application Priority Data

Sep. 18, 2020 (CN) ..... 202010987735.3

(51) Int. Cl.
*G09G 3/36* (2006.01)

(52) U.S. Cl.
CPC ..... *G09G 3/3607* (2013.01); *G09G 3/3614* (2013.01); *G09G 2300/0452* (2013.01); *G09G 2320/0209* (2013.01)

(58) Field of Classification Search
CPC ..... G09G 3/3607; G09G 3/3614; G09G 2300/0452; G09G 2320/0209; G02F 1/136286
See application file for complete search history.

(56) References Cited

U.S. PATENT DOCUMENTS

| | | | | |
|---|---|---|---|---|
| 9,905,187 | B2 | 2/2018 | Hwang et al. | |
| 2002/0149598 | A1* | 10/2002 | Greier | G09G 3/3611 345/589 |
| 2005/0206597 | A1 | 9/2005 | Ishii | |
| 2010/0001942 | A1 | 1/2010 | Lin et al. | |
| 2014/0354707 | A1* | 12/2014 | Tsuei | G09G 3/3614 345/690 |

(Continued)

FOREIGN PATENT DOCUMENTS

| | | |
|---|---|---|
| CN | 1918621 | 2/2007 |
| CN | 102800276 | 11/2012 |

(Continued)

*Primary Examiner* — David Tung

(57) ABSTRACT

A display panel and a driving method thereof are provided. The display panel includes a plurality of subpixels and a plurality of data lines. The plurality of subpixels are divided into a plurality of unit regions. Two sides of any column of the subpixels correspond to two of the data lines with different polarities respectively. The polarities of the subpixels of any column are same. The unit regions include a plurality of unit subregions. Grayscales of the subpixels in each unit subregion are same, and grayscales of the subpixels in two adjacent unit subregions are different.

18 Claims, 3 Drawing Sheets

(56) References Cited

U.S. PATENT DOCUMENTS

| | | | | |
|---|---|---|---|---|
| 2018/0226045 | A1* | 8/2018 | Sohn | G02F 1/13306 |
| 2019/0206341 | A1 | 7/2019 | Liao et al. | |
| 2019/0272784 | A1 | 9/2019 | Huang et al. | |

FOREIGN PATENT DOCUMENTS

| | | |
|---|---|---|
| CN | 104183221 | 12/2014 |
| CN | 107895568 | 4/2018 |
| CN | 108172194 | 6/2018 |
| CN | 108766373 | 11/2018 |
| CN | 110033739 | 7/2019 |
| CN | 110223645 | 9/2019 |
| CN | 111128090 | 5/2020 |

* cited by examiner

DISPLAY PANEL AND DRIVING METHOD THEREOF

RELATED APPLICATIONS

This application is a National Phase of PCT Patent Application No. PCT/CN2020/129952 having International filing date of Nov. 19, 2020, which claims the benefit of priority of Chinese Patent Application No. 202010987735.3 filed on Sep. 18, 2020. The contents of the above applications are all incorporated by reference as if fully set forth herein in their entirety.

FIELD AND BACKGROUND OF THE INVENTION

The present disclosure relates to the field of display, and particularly to a display panel and a driving method thereof.

With development of display technology, in large dimension and high resolution liquid crystal display panels, such as liquid crystal display panels with 8K pixels, and in a situation that dimensions of the display panels are unchanged, increments of resolution causes aperture ratio of the display panels to reduce, thereby reducing penetration rates of the display panels, preventing eight-domain pixel electrode structures conducive to improving viewing angles from being used in high resolution display products due to low penetration rate thereof. Four-domain pixel electrode structures take the place of the eight-domain pixel electrode structures, but they worsen viewing angle characteristics. Therefore, compensation on viewing angles of high resolution display panels is needed. Generally, a plurality of subpixels are used to compose one compensation unit in viewing angle compensation, so an effect similar to compensation from main-pixel electrodes and sub-pixel electrodes in the eight-domain pixel electrode structures is performed. While current subpixel array structures for viewing angle compensation, ways in which a positive polarity, a negative polarity, a positive polarity, and a negative polarity using horizontal polarities are inverse can cause horizontal crosstalk effect when a viewing angle compensation algorithm is executed.

Currently, in order to prevent the problem of horizontal crosstalk generated in a process of viewing angle compensation, a first solution illustrated in FIG. 1 or a second solution illustrated in FIG. 2 is used primarily. As illustrated in FIG. 1, although subpixel array structures of the first solution remedies the problem of horizontal crosstalk, regions for displaying same grayscale in FIG. 1 are large, which causes rough graininess of display and affects picture quality of the display panels. As illustrated in FIG. 2, horizontal polarities in an array structure of the subpixels are in a cycle of a positive polarity, a negative polarity, a positive polarity, and a negative polarity. Although influence of roughness on display images is prevented, two-column inverse is required in vertical polarities, which easily causes operation temperature of integrated circuits for driving arrays of subpixel to increase and also causes problems of decrement of charging rate and increment of power consumption.

SUMMARY OF THE INVENTION

The present disclosure provides a display panel and a driving method thereof to solve a technical problems of graininess displayed on the display panels or decrement of charging rate incurred by current high resolution display panels remedying horizontal crosstalk problems.

In order to solve the problems mentioned above, the present disclosure provides following technical solutions.

The present disclosure provides a display panel, including:

a plurality of subpixels arranged in a matrix manner, wherein the plurality of subpixels are divided into a plurality of unit regions repeatedly arranged along rows and columns, and any one of the unit regions includes the plurality of subpixels arranged in a 2×12 matrix manner;

a plurality of scanning lines transmitting scanning signals to each of the subpixels, wherein the subpixels of each row correspond to one of the scanning lines; and a plurality of data lines transmitting data signals to each of the subpixels, wherein one of the data lines is disposed between the subpixels of two adjacent rows, wherein two sides of the subpixels of any column respectively correspond to two data lines with different polarities, and each of the subpixels of any column has a same polarity, the unit regions include a plurality of unit subregions, grayscales of the subpixels of each of the unit subregions are same, grayscales of the subpixels of any two adjacent unit subregions are different, a number of the subpixels included by any unit subregion is less than or equal to two, and a number of the unit subregions including two of the subpixels is two.

In the display panel provided by the present disclosure, the plurality of unit subregions include two first unit subregions and a plurality of second unit subregions, the first unit subregion includes two of the subpixels, the second unit subregion includes one of the subpixels, the two first unit subregions are located on a middle section of the unit regions, and the two first unit subregions are adjacent to each other.

In the display panel provided by the present disclosure, any of the subpixels is a high grayscale subpixel or a low grayscale subpixel, the subpixels of first rows of the unit regions are configured as first grayscale groups, the subpixels of second rows of the unit regions are configured as second grayscale groups, and grayscales of the first grayscale groups and the second grayscale groups are correspondingly opposite.

In the display panel provided by the present disclosure, an arrangement sequence of the first grayscale group is high grayscale, low grayscale, high grayscale, low grayscale, high grayscale, low grayscale, low grayscale, high grayscale, low grayscale, high grayscale, low grayscale, and high grayscale, and an arrangement sequence of the second grayscale group is low grayscale, high grayscale, low grayscale, high grayscale, low grayscale, high grayscale, high grayscale, low grayscale, high grayscale, low grayscale, high grayscale, and low grayscale.

In the display panel provided by the present disclosure, the subpixel is a red subpixel, a green subpixel, or a blue subpixel, and two of the subpixels in the first unit subregion are the red subpixel and the blue subpixel.

In the display panel provided by the present disclosure, a grayscale arrangement sequence of the subpixels of first columns of the unit regions and a grayscale arrangement sequence of the subpixels of twelfth columns of the unit regions are same, the subpixels of the first columns of the unit regions are the red subpixels, and the subpixels of the twelfth columns of the unit regions are the blue subpixels.

In the display panel provided by the present disclosure, the subpixels of each row are arranged repeatedly in a sequence of the red subpixel, the green subpixel, and the blue subpixel in the unit regions.

In the display panel provided by the present disclosure, the subpixels of first rows of the unit regions are configured as a first polarity group, the subpixels of second rows of the unit regions are configured as a second polarity group, polarities of the first polarity group and the second polarity group are same, the first polarity groups and the second polarity groups are arranged repeatedly in a sequence of a positive polarity and a negative polarity, wherein any subpixel has a polarity opposite to a first frame in a second frame.

In the display panel provided by the present disclosure, there are twelve data lines in the unit region correspondingly, in the unit region, a polarity of each data line is arranged repeatedly in a sequence of a positive polarity and a negative polarity.

In the display panel provided by the present disclosure, the scanning line corresponding to the subpixels of the first row in the unit region is a first scanning line, the scanning line corresponding to the subpixels of the second row in the unit region is a second scanning line, and the first scanning line and the second scanning line are in parallel connection.

The present disclosure further provides a driving method of the display panel, including following steps:

arranging a plurality of unit subregions in a matrix manner to form a plurality of subpixels arranged along rows and columns repeatedly, wherein any one of the unit regions includes the plurality of subpixels arranged in a 2×12 matrix manner, grayscales of the subpixels of each of the unit subregions are same, grayscales of the subpixels of any two adjacent unit subregions are different, a number of the subpixels included by any unit subregion is less than or equal to two, and a number of the unit subregions comprising two of the subpixels is two, transmitting scanning signals to each of the subpixels by a plurality of scanning lines, wherein the subpixels of each row correspond to one of the scanning lines; and transmitting data signals to each of the subpixels by a plurality of data lines, wherein one of the data lines is disposed between the subpixels of two adjacent rows, two sides of the subpixels of any column respectively correspond to two data lines with different polarities, and each of the subpixels of any column has a same polarity.

The beneficial effect of the present disclosure is that by making the polarities of each of the subpixels of any column to be same, the present disclosure remedies the problem of horizontal crosstalk of the display panel. Furthermore, two sides of the subpixels of any column respectively correspond to two data lines with different polarities, that is, the horizontal polarities repeat in a manner, such as repeats by a positive polarity and a negative polarity, and vertical polarities can be inversed by one column, preventing decrement of charging rate incurred by increment of operation temperature of integrated circuits for driving arrays of subpixels. In addition, by making the number of the subpixels included by any unit subregion less than or equal to two and determining the number of the unit subregions including two of the subpixels to be two, influence of rough graininess generated from display of the display panels is minimized.

DESCRIPTION OF DRAWINGS BRIEF DESCRIPTION OF THE SEVERAL VIEWS OF THE DRAWINGS

In order to more clearly illustrate embodiments or the technical solutions of the present disclosure, the accompanying figures of the present disclosure required for illustrating embodiments or the technical solutions of the present disclosure will be described in brief. Obviously, the accompanying figures described below are only part of the embodiments of the present disclosure, from which those skilled in the art can derive further figures without making any inventive efforts.

FIG. 3 is in a first frame.

FIG. 3 is in a second frame.

DESCRIPTION OF SPECIFIC EMBODIMENTS OF THE INVENTION

Figure 1:
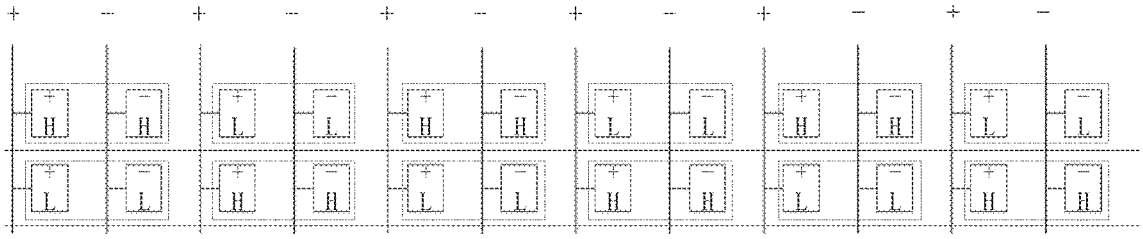
FIG. 1 is a first structural schematic diagram of an arrangement of current subpixels.

The descriptions of embodiments below refer to accompanying drawings in order to illustrate certain embodiments which the present disclosure can implement. The directional terms of which the present disclosure mentions, for example, "top", "bottom", "upper", "lower", "front", "rear", "left", "right", "inside", "outside", "side", etc., are only refer to directions of the accompanying figures. Therefore, the used directional terms are for illustrating and understanding the present disclosure, but not for limiting the present disclosure. In the figures, units with similar structures are indicated by the same reference numerals.

In the description of the present disclosure, it is to be understood that the orientation or positional relationship indicated by the terms "center", "longitudinal", "transverse", "length", "width", "thickness", "upper", "lower", "front", "rear", "left", "right", "vertical", "horizontal", "top", "bottom", "inside", "outside", "clockwise", "counterclockwise" etc. is based on the orientation or positional relationship shown in the accompanying figures, which is merely for the convenience for describing of the present disclosure and for the simplification of the description, and is not intended to indicate or imply that the indicated devices or elements have a specific orientation or is constructed and operated in a specific orientation. Therefore, it should not be understood as a limitation on the present disclosure. Moreover, the terms "first" and "second" are used for descriptive purposes only and are not to be understood as indicating or implying relative importance or implicitly indicating the number of the indicated technical characteristics. Therefore, the characteristics defined by "first" or "second" may include one or more of the described characteristics either explicitly or implicitly. In the description of the present disclosure, the meaning of "a plurality" is two or more unless clearly and specifically defined otherwise.

In the description of the present disclosure, unless specified or limited otherwise, terms "mounted," "connected," "coupled," and the like are used in a broad sense, and may include, for example, fixed connections, detachable connections, or integral connections; may also be mechanical or electrical connections or may be communication between each other; may also be direct connections or indirect connections via intervening structures; may also be inner communications of two elements or may be a relationship of interaction between two elements. For persons skilled in the art in this field, the specific meanings of the above terms in the present disclosure can be understood with specific cases.

In the present disclosure, unless expressly specified or limited otherwise, a first feature is "on" or "beneath" a second feature may include that the first feature directly contacts the second feature and may also include that the first feature does not directly contact the second feature. Furthermore, a first feature "on," "above," or "on top of" a second feature may include an embodiment in which the first feature is right "on," "above," or "on top of" the second feature and may also include that the first feature is not right "on," "above," or "on top of" the second feature, or just means that the first feature has a sea level elevation higher than the sea level elevation of the second feature. While first feature "beneath," "below," or "on bottom of" a second feature may include that the first feature is "beneath," "below," or "on bottom of" the second feature and may also include that the first feature is not right "beneath," "below," or "on bottom of" the second feature, or just means that the first feature has a sea level elevation lower than the sea level elevation of the second feature.

The following disclosure provides many different embodiments or examples for implementing the different structures of the present disclosure. In order to simplify the disclosure of the present disclosure, the assemblies and configurations of the specific examples are described below. Of course, they are merely examples and are not intended to limit the present disclosure. In addition, the present disclosure may repeat reference numerals and/or reference numerals in different examples, which are for the purpose of simplicity and clarity, and do not indicate the relationship between the various embodiments and/or arrangements discussed. Moreover, the present disclosure provides embodiments of various specific processes and materials, but one of ordinary skill in the art will recognize the use of other processes and/or the use of other materials.

Hereinafter, the technical solution of the present disclosure is described with reference to specific embodiments.

Figure 3:
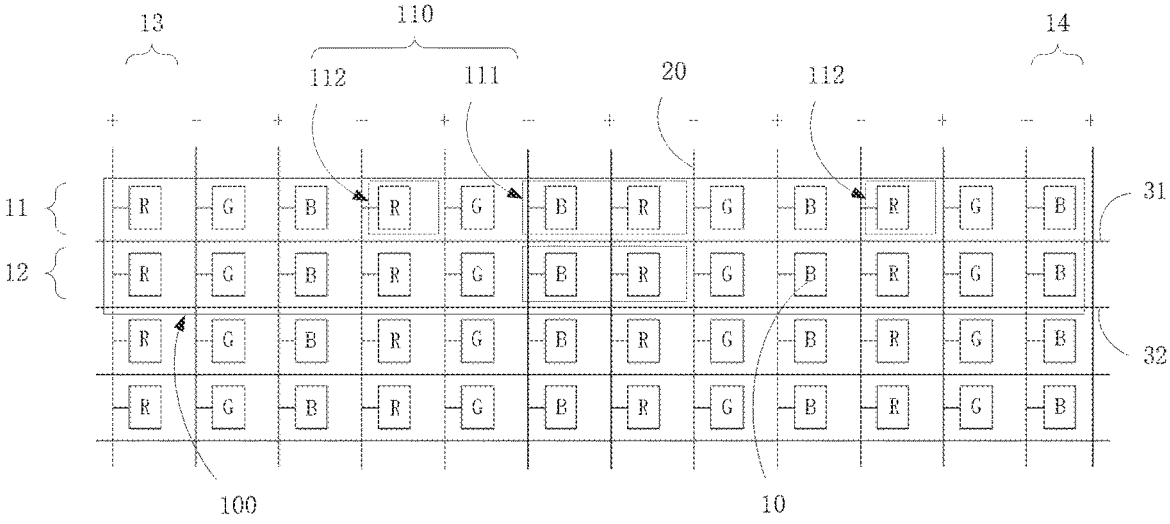
FIG. 3 is a structural schematic diagram of an arrangement of subpixels in a display panel of an embodiment of the present disclosure.
Figure 4:
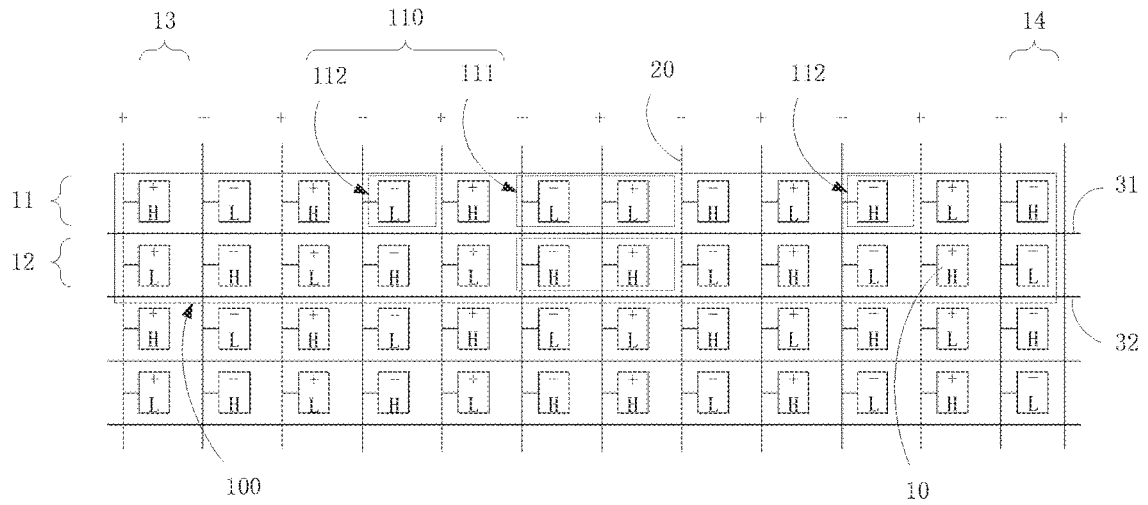
FIG. 4 is a structural schematic diagram of grayscales and polarities when
Figure 5:
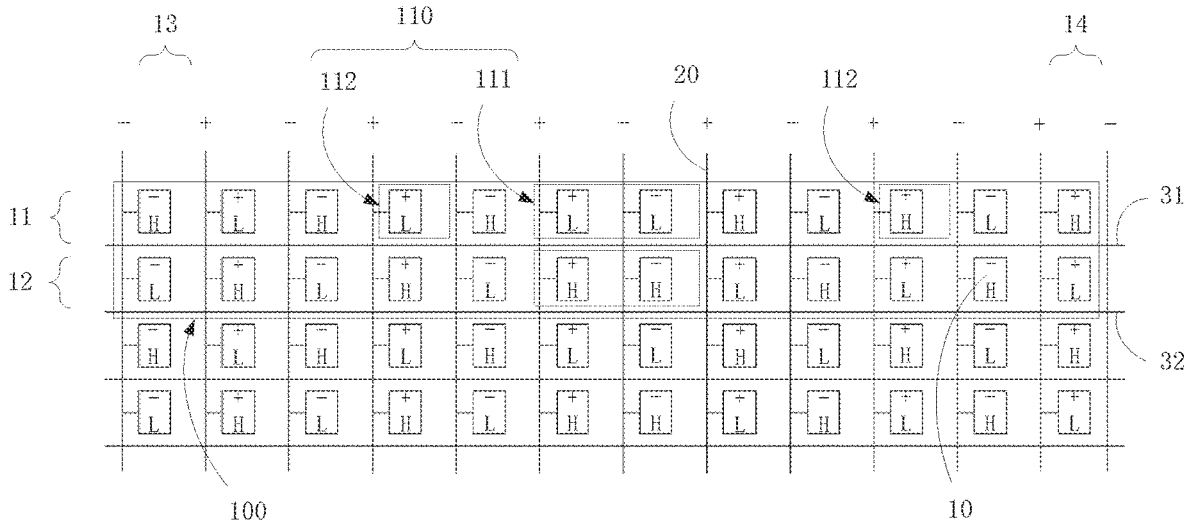
FIG. 5 is a structural schematic diagram of grayscales and polarities when

The present disclosure provides a display panel as illustrated in FIG. 3 to FIG. 5, including:

a plurality of subpixels 10 arranged in a matrix manner, wherein the plurality of subpixels are divided into a plurality of unit regions 100 repeatedly arranged along rows and columns, and any one of the unit regions 100 includes the plurality of subpixels 10 arranged in a 2×12 matrix manner;

a plurality of scanning lines transmitting scanning signals to each of the subpixels 10, wherein the subpixels 10 of each row correspond to one of the scanning lines; and a plurality of data lines 20 transmitting data signals to each of the subpixels 10, wherein one of the data lines 20 is disposed between the subpixels 10 of two adjacent columns, wherein two sides of the subpixels 10 of any column respectively correspond to the data lines 20 with different polarities, and each of the subpixels 10 of any column has a same polarity.

The unit regions 100 include a plurality of unit subregions 110. Grayscales of the subpixels 10 of each of the unit subregions 110 are same. Grayscales of the subpixels 10 of any two adjacent unit subregions 110 are different. A number of the subpixels 10 included by any unit subregion 110 is less than or equal to two, and a number of the unit subregions 110 including two of the subpixels 10 is two.

Figure 2:
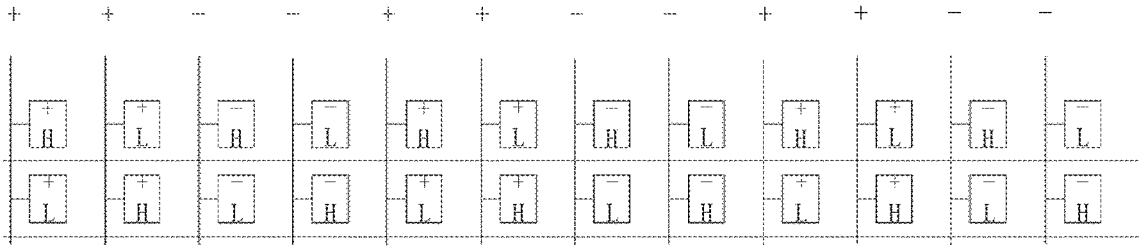
FIG. 2 is a second structural schematic diagram of an arrangement of the current subpixels.

It can be understood that, currently, in order to prevent a problem from horizontal crosstalk generated in a process of viewing angle compensation, a first solution illustrated in FIG. 1 or a second solution illustrated in FIG. 2 is used primarily. As illustrated in FIG. 1, although subpixel array structures of the first solution remedies the problem of horizontal crosstalk, regions for displaying same grayscale in FIG. 1 are large, which causes rough graininess of display and affects picture quality of the display panels. As illustrated in FIG. 2, horizontal polarities in an array structure of the subpixels 10 of the second solution repeats by a positive polarity, a positive polarity, a negative polarity, and a negative polarity. Although influence of roughness on display screens is prevented, two-column inverse is required in vertical polarities, which easily causes operation temperature of integrated circuits of driving subpixel arrays to increase and also causes problems of decrement of charging rate and increment of power consumption. In this embodiment, by making the polarities of each of the subpixels 10 of any column to be same, the problem of horizontal crosstalk of the display panel is remedied. Furthermore, two sides of the subpixels 10 of any column respectively correspond to the data lines 20 with different polarities; that is, the vertical polarities repeat in a manner, such as by positive polarity and negative polarity, preventing decrement of charging rate incurred by increment of operation temperature of integrated circuits for driving arrays of the subpixels 10. In addition, making the number of the subpixels 10 included by any unit subregion 110 to be less than or equal to two and limiting the number of the unit subregions 110 including two of the subpixels be two minimize influence of rough graininess generated from display of the display panels.

It is worth noting that in this embodiment, the plurality of subpixels 10 arranged in the 2×12 matrix manner in the unit regions 100 can act as a minimum repeating unit. Specifically, the plurality of subpixels 10 arranged in a 2N×12M matrix manner can act as a repeating unit for arrangement, wherein N and M are integers. Specifically, in the present disclosure, description is taken by the plurality of subpixels 10 arranged in the 2×12 matrix manner in the unit regions 100 acting as the minimum repeating unit.

In an embodiment, as illustrated in FIG. 4, the plurality of unit subregions 110 include two first unit subregions 111 and a plurality of second unit subregions 112. The first unit subregion 111 includes two of the subpixels 10. The second unit subregion 112 includes one of the subpixels 10.

The two first unit subregions 111 are located on a middle section of the unit region 100, and the two first unit subregions 111 are adjacent to each other.

It can be understood that disposing the two first unit subregions 111 on the middle section of the unit regions 100; that is, disposing the first unit subregions 111 with rough graininess in the display screen on the middle section of the unit region 100, which maximizes an interval between the two first unit subregions 111 with the rough graininess located on two adjacent unit regions 100 and also enables each of the first unit subregions 111 in the display panel to evenly distribute in the screen of the display panel, maximizing prevention of influence of the rough graininess of the display screen.

In an embodiment, as illustrated in FIG. 4 to FIG. 5, any of the subpixels 10 is a high grayscale subpixel or a low grayscale subpixel. The subpixels 11 of first rows of the unit regions 100 are configured as first grayscale groups. The subpixels 12 of second rows of the unit regions 100 are configured as second grayscale groups. Grayscales of the first grayscale groups and the second grayscale groups are opposite. It can be understood that by making the grayscales of the first grayscale groups and the second grayscale groups opposite, prevention of aggregated arrangement of the subpixels 10 with same grayscales from can be maximized, thereby more facilitating to ensuring quality of the display screen of the display panel.

Specifically, as illustrated in FIG. 4, the first grayscale group is arranged in a sequence of high grayscale, low grayscale, high grayscale, low grayscale, high grayscale, low grayscale, low grayscale, and high grayscale, low grayscale, high grayscale, low grayscale, and high grayscale. The second grayscale group is arranged in a sequence of low grayscale, high grayscale, low grayscale, high grayscale, low grayscale, high grayscale, high grayscale, low grayscale, high grayscale, low grayscale, high grayscale, and low grayscale. Obviously, in the first grayscale group, two consecutive low grayscales are located in sixth and seventh columns; in the first grayscale group, two consecutive high grayscales are also located in the sixth and seventh columns. That is, the same two grayscales arranged together are located in the middle positions of each row of the subpixels 10.

In an embodiment, as illustrated in FIG. 3, the subpixel 10 is a red subpixel R, a green subpixel G, or a blue subpixel B.

Two of the subpixels 10 in the first unit subregion 111 are the red subpixel R and the blue subpixel B.

It can be understood that compared to a displayed color of the green subpixel G, display colors of the red subpixel R and the blue subpixel B are darker. Configuring the two subpixels 10 in the first unit subregions 111 as the red subpixel R and the blue subpixel B, which is conducive to preventing the graininess of the display screen located on the first unit subregions 111 being overly prominent and helps to improve user experience.

In an embodiment, as illustrated in FIG. 3 to FIG. 5, a grayscale arrangement sequence of the subpixels of first columns 13 of the unit regions 100 and a grayscale arrangement sequence of the subpixels of twelfth columns 14 of the unit regions 100 are same. The subpixels of the first columns 13 of the unit regions 100 are the red subpixels R, and the subpixels of the twelfth columns 14 of the unit regions 100 are the blue subpixels B. It can be understood that the grayscale arrangement sequence of the subpixels of first columns 13 of the unit regions 100 and the grayscale arrangement sequence of the subpixels of twelfth columns 14 of the unit regions 100 are same. In a horizontal direction, a situation that two consecutive subpixels 10 are high grayscales or low grayscales at a junction location of two adjacent unit regions 100 is common, thereby resulting in rough graininess at the junction location of the two adjacent unit regions 100. By configuring the subpixels of first columns 13 in the unit region 100 as the red subpixels R and configuring the subpixels of twelfth columns 14 in the unit region 100 as the blue subpixels B, the graininess of the display screen located on the junction location of the two adjacent unit regions 100 are prone to be prevented from being overly prominent, which helps to improve user experience. Specifically, the subpixels 10 of each row are arranged repeatedly in a sequence of the red subpixel R, the green subpixel G, and the blue subpixel B.

In one embodiment, as illustrated in FIG. 3, the subpixels of first rows 11 of the unit regions 100 are configured as a first polarity group, and the subpixels of second rows 12 of the unit regions 100 are configured as a second polarity group. Polarities of the first polarity group and the second polarity group are same.

The first polarity groups and the second polarity groups are arranged repeatedly in a sequence of a positive polarity and a negative polarity.

Furthermore, as illustrated in FIG. 4 to FIG. 5, any subpixel 10 has a polarity opposite to a first frame in a second frame. It can be understood that the first polarity groups and the second polarity groups arranged repeatedly in the sequence of the positive polarity and the negative polarity makes inversed by one column can be used in the vertical polarities of the plurality of subpixels 10 arranged in the matrix manner, which prevents decrement of charging rate incurred by increment of operation temperature of integrated circuits for driving arrays of the subpixels 10. Specifically, there are twelve data lines 20 in the unit region 100 correspondingly, and in the unit region 100, a polarity of each data line 20 is arranged repeatedly in a sequence of a positive polarity and a negative polarity.

In an embodiment, as illustrated in FIG. 3, the scanning line corresponding to the subpixels of the first row 11 in the unit region 100 is a first scanning line 31, and the scanning line corresponding to the subpixels of the second row 12 in the unit region 100 is a second scanning line 32. Obviously, the first scanning line 31 and the second scanning line 32 can perform control respectively, or unified control can be realized by connecting the first scanning line 31 and the second scanning line 32 in parallel connection.

Figure 6:
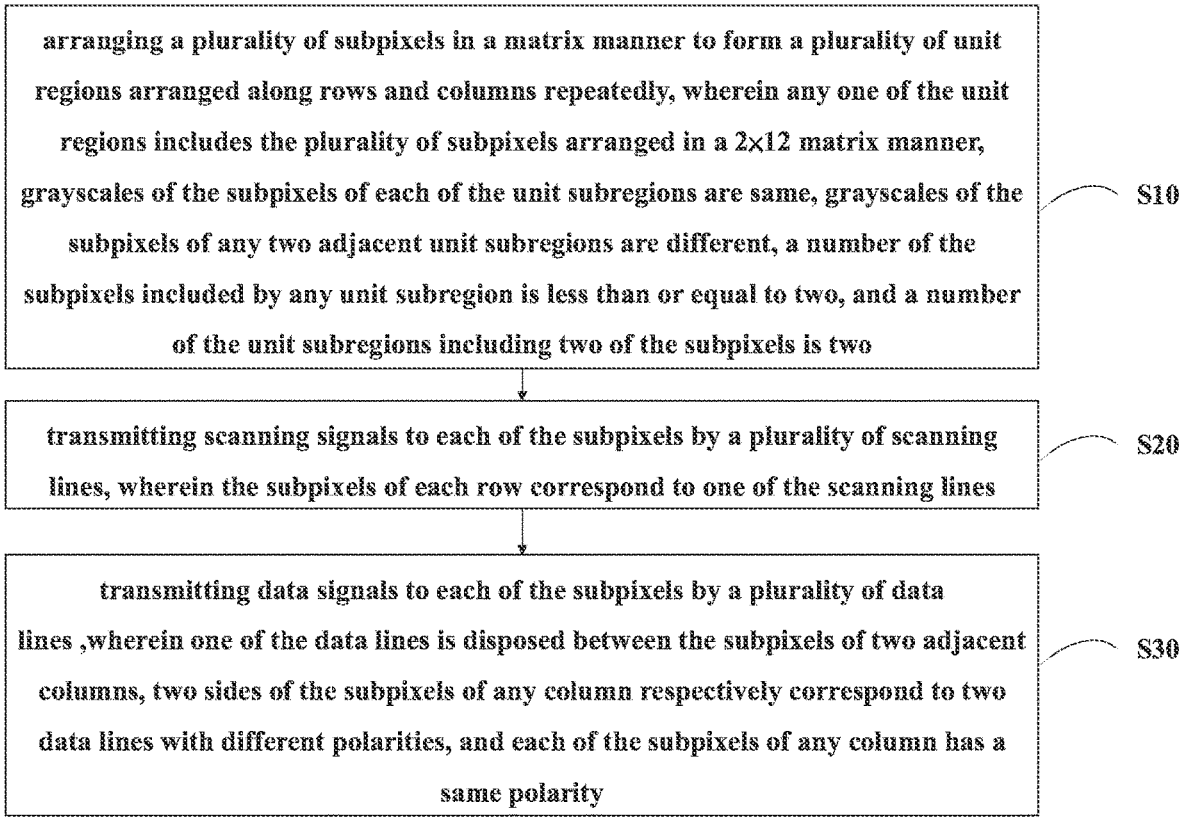
FIG. 6 is a flowchart of a driving method of the display panel of an embodiment of the present disclosure.

As illustrated in FIG. 6, the present disclosure further provides a driving method of the display panel, including following steps.

Step S10: arranging a plurality of subpixels 10 in a matrix manner to form a plurality of unit regions 100 arranged along rows and columns repeatedly. Any one of the unit regions 100 includes the plurality of subpixels 10 arranged in a 2×12 matrix manner. Wherein, grayscales of the subpixels 10 of each of the unit subregions 110 are same, grayscales of the subpixels 10 of any two adjacent unit subregions 110 are different, a number of the subpixels 10 included by any unit subregion 110 is less than or equal to two, and a number of the unit subregions 110 including two of the subpixels 110 is two.

Step S20: transmitting scanning signals to each of the subpixels 10 by a plurality of scanning lines. The subpixels 10 of each row correspond to one of the scanning lines.

Step S30: transmitting data signals to each of the subpixels 10 by a plurality of data lines 20. One of the data lines 20 is disposed between the subpixels 10 of two adjacent columns. Two sides of the subpixels 10 of any column respectively correspond to two data lines 20 with different polarities, and each of the subpixels 10 of any column has a same polarity.

In summary, by making the polarities of each of the subpixels 10 of any column to be same, the present disclosure remedies the problem of horizontal crosstalk of the display panel. Furthermore, two sides of the subpixels 10 of any column respectively correspond to two data lines 20 with different polarities; that is, the horizontal polarities repeat in a manner, such as by a positive polarity and a negative polarity, and vertical polarities can be inversed by one column, preventing decrement of charging rate incurred by increment of operation temperature of integrated circuits for driving arrays of the subpixels 10. In addition, by making the number of the subpixels 10 included by any unit subregion 110 less than or equal to two and determining the number of the unit subregions 110 including two of the subpixels 10 to be two, influence of rough graininess generated from display of the display panels is minimized.

In summary, although the present disclosure has disclosed the preferred embodiments as above, however the above-mentioned preferred embodiments are not to limit to the present disclosure. A person skilled in the art can make any change and modification, therefore the scope of protection of the present disclosure is subject to the scope defined by the claims.

What is claimed is:

1. A display panel, comprising:

a plurality of subpixels arranged in a matrix manner, wherein the plurality of subpixels are divided into a plurality of unit regions repeatedly arranged along rows and columns, and any one of the unit regions comprises the subpixels arranged in a 2×12 matrix manner;

a plurality of scanning lines transmitting scanning signals to each of the subpixels, wherein the subpixels of each row correspond to one of the scanning lines; and a plurality of data lines transmitting data signals to each of the subpixels, wherein one of the data lines is disposed between the subpixels of two adjacent columns, wherein two sides of the subpixels of any column respectively correspond to two data lines with different polarities, and each of the subpixels of any column has a same polarity, each of the unit regions comprises a plurality of unit subregions, grayscales of the subpixels of each of the unit subregions are same, grayscales of the subpixels of any two adjacent one of the unit subregions are different, a number of the subpixels comprised by any one of the unit subregions is less than or equal to two, and among the plurality of unit subregions in each of the unit regions, a number of the unit subregions comprising two of the subpixels is two and each of remaining ones of the plurality of unit subregions comprise one of the subpixels.

2. The display panel as claimed in claim 1, wherein in each of the unit regions, the plurality of unit subregions comprise two first unit subregions and a plurality of second unit subregions, each of the first unit subregions comprises two of the subpixels, each of the second unit subregions comprises one of the subpixels, the two first unit subregions are located on a middle section of each of the unit regions, at least two of the plurality of second unit subregions are adjacent to each other in a row direction, and the two first unit subregions are adjacent to each other.

3. The display panel as claimed in claim 2, wherein any of the subpixels is a high grayscale subpixel or a low grayscale subpixel, the subpixels of first rows of the unit regions are configured as first grayscale groups, the subpixels of second rows of the unit regions are configured as second grayscale groups, and grayscales of the first grayscale groups and the second grayscale groups are correspondingly opposite.

4. The display panel as claimed in claim 3, wherein an arrangement sequence of each of the first grayscale groups is high grayscale, low grayscale, high grayscale, low grayscale, high grayscale, low grayscale, low grayscale, high grayscale, low grayscale, high grayscale, low grayscale, and high grayscale, and an arrangement sequence of each of the second grayscale groups is low grayscale, high grayscale, low grayscale, high grayscale, low grayscale, high grayscale, high grayscale, low grayscale, high grayscale, low grayscale, high grayscale, and low grayscale.

5. The display panel as claimed in claim 2, wherein any of the subpixels is a red subpixel, a green subpixel, or a blue subpixel, and the subpixels in each of the first unit subregions are the red subpixel and the blue subpixel.

6. The display panel as claimed in claim 5, wherein a grayscale arrangement sequence of the subpixels of first columns of the unit regions and a grayscale arrangement sequence of the subpixels of twelfth columns of the unit regions are same, the subpixels of the first columns of the unit regions are the red subpixels, and the subpixels of the twelfth columns of the unit regions are the blue subpixels.

7. The display panel as claimed in claim 6, wherein the subpixels of each row are arranged repeatedly in a sequence of the red subpixel, the green subpixel, and the blue subpixel in each of the unit regions.

8. The display panel as claimed in claim 6, wherein in each row in each of the unit regions, grayscale of the subpixel of the first column or the twelfth column is opposite to that of the subpixels of the first unit subregion.

9. The display panel as claimed in claim 1, wherein the subpixels of first row of each of the unit regions are configured as a first polarity group, the subpixels of second row of each of the unit regions are configured as a second polarity group, and polarities of the first polarity group and the second polarity group are same, the first polarity groups and the second polarity groups are arranged repeatedly in a sequence of a positive polarity and a negative polarity, wherein any of the subpixels has a polarity opposite to a first frame in a second frame.

10. The display panel as claimed in claim 1, wherein there are twelve data lines in each of the unit regions correspondingly, and in the unit region, a polarity of each of the data lines is arranged repeatedly in a sequence of a positive polarity and a negative polarity.

11. A display panel, comprising:

a plurality of subpixels arranged in a matrix manner, wherein the plurality of subpixels are divided into a plurality of unit regions repeatedly arranged along rows and columns, and any one of the unit regions comprises the subpixels arranged in a 2×12 matrix manner;

a plurality of scanning lines transmitting scanning signals to each of the subpixels, wherein the subpixels of each row correspond to one of the scanning lines; and a plurality of data lines transmitting data signals to each of the subpixels, wherein one of the data lines is disposed between the subpixels of two adjacent columns, wherein two sides of the subpixels of any column respectively correspond to two data lines with different polarities, and each of the subpixels of any column has a same polarity, each of the unit regions comprises a plurality of unit subregions, grayscales of the subpixels of each of the unit subregions are same, grayscales of the subpixels of any two adjacent one of the unit subregions are different, a number of the subpixels comprised by any one of the unit subregions is less than or equal to two, and among the plurality of unit subregions in each of the unit regions, a number of the unit subregions comprising two of the subpixels is two and each of remaining ones of the plurality of unit subregions comprise one of the subpixels, in each of the unit regions, the plurality of unit subregions comprise two first unit subregions and a plurality of second unit subregions, each of the first unit subregions comprises two of the subpixels, each of the second unit subregions comprises one of the subpixels, the two first unit subregions are located on a middle section of each of the unit regions, and the two first unit subregions are adjacent to each other, the subpixels of first row of each of the unit regions are configured as a first polarity group, the subpixels of second row of each of the unit regions are configured as a second polarity group, polarities of the first polarity group and the second polarity group are same, and the first polarity groups and the second polarity groups are arranged repeatedly in a sequence of a positive polarity and a negative polarity, and wherein any of the subpixels has a polarity opposite to a first frame in a second frame.

12. The display panel as claimed in claim 11, wherein any of the subpixels is a high grayscale subpixel or a low grayscale subpixel, the subpixels of first rows of the unit regions are configured as first grayscale groups, the subpixels of second rows of the unit regions are configured as second grayscale groups, and grayscales of the first grayscale groups and the second grayscale groups are correspondingly opposite.

13. The display panel as claimed in claim 12, wherein an arrangement sequence of each of the first grayscale groups is high grayscale, low grayscale, high grayscale, low grayscale, high grayscale, low grayscale, low grayscale, high grayscale, low grayscale, high grayscale, low grayscale, and high grayscale, and an arrangement sequence of each of the second grayscale groups is low grayscale, high grayscale, low grayscale, high grayscale, low grayscale, high grayscale, high grayscale, low grayscale, high grayscale, low grayscale, high grayscale, and low grayscale.

14. The display panel as claimed in claim 11, wherein any of the subpixels is a red subpixel, a green subpixel, or a blue subpixel, and the subpixels in each of the first unit subregions are the red subpixel and the blue subpixel.

15. The display panel as claimed in claim 14, wherein a grayscale arrangement sequence of the subpixels of first columns of the unit regions and a grayscale arrangement sequence of the subpixels of twelfth columns of the unit regions are same, the subpixels of the first columns of the unit regions are the red subpixels, and the subpixels of the twelfth columns of the unit regions are the blue subpixels.

16. The display panel as claimed in claim 15, wherein the subpixels of each row are arranged repeatedly in a sequence of the red subpixel, the green subpixel, and the blue subpixel in each of the unit regions.

17. The display panel as claimed in claim 11, wherein there are twelve data lines in each of the unit regions correspondingly, and in the unit region, a polarity of each of the data lines is arranged repeatedly in a sequence of a positive polarity and a negative polarity.

18. A driving method of a display panel comprising following steps:

arranging a plurality of unit subpixels in a matrix manner to form a plurality of unit regions arranged along rows and columns repeatedly, wherein any one of the unit regions comprises the subpixels arranged in a 2×12 matrix manner, each of the unit regions comprises a plurality of unit subregions, grayscales of the subpixels of each of the unit subregions are same, grayscales of the subpixels of any two adjacent one of the unit subregions are different, a number of the subpixels comprised by any one of the unit subregions is less than or equal to two, and among the plurality of unit subregions in each of the unit regions, a number of the unit subregions comprising two of the subpixels is two and each of remaining ones of the plurality of unit subregions comprise one of the subpixels, transmitting scanning signals to each of the subpixels by a plurality of scanning lines, wherein the subpixels of each row correspond to one of the scanning lines; and transmitting data signals to each of the subpixels by a plurality of data lines, wherein one of the data lines is disposed between the subpixels of two adjacent columns, two sides of the subpixels of any column respectively correspond to two data lines with different polarities, and each of the subpixels of any column has a same polarity.

* * * * *